United States Patent [19]

Longsworth et al.

[11] 4,237,699

[45] Dec. 9, 1980

[54] VARIABLE FLOW CRYOSTAT WITH DUAL ORIFICE

[75] Inventors: Ralph C. Longsworth, Allentown; Matthew G. Chalmers, Mertztown, both of Pa.

[73] Assignee: Air Products and Chemicals, Inc., Allentown, Pa.

[21] Appl. No.: 41,963

[22] Filed: May 23, 1979

[51] Int. Cl.[3] ..... F25B 19/00

[52] U.S. Cl. ..... 62/514 JT

[58] Field of Search ..... 62/514 JT, 222

[56] References Cited

U.S. PATENT DOCUMENTS

| | | | |
|---|---|---|---|
| 3,517,525 | 6/1970 | Campbell | 62/222 |
| 3,704,597 | 12/1972 | Nicholds | 62/222 |
| 3,728,868 | 4/1973 | Longsworth | 62/222 |
| 3,747,365 | 7/1973 | Nicholds | 62/514 JT |
| 3,818,720 | 6/1974 | Campbell | 62/514 JT |
| 3,827,252 | 8/1974 | Chovet et al. | 62/222 |

FOREIGN PATENT DOCUMENTS

| | | | |
|---|---|---|---|
| 1238470 | 7/1971 | United Kingdom | 62/222 |

*Primary Examiner*—Ronald C. Capossela

*Attorney, Agent, or Firm*—James C. Simmons; E. Eugene Innis

[57] ABSTRACT

A cryostat for producing an inventory of a liquefied working fluid by expansion of the working fluid through an orifice, the cryostat including means to rapidly cool the cryostat to operating temperature and to maintain fluid flow at low temperature and high working fluid pressure to maintain maximum heat transfer between the working fluid and an object being cooled by the cryostat.

9 Claims, 7 Drawing Figures

FIG. 1
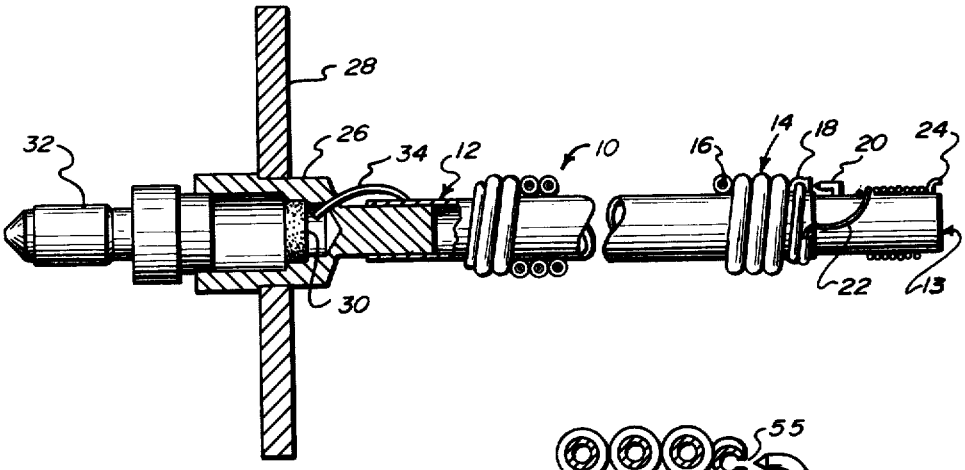
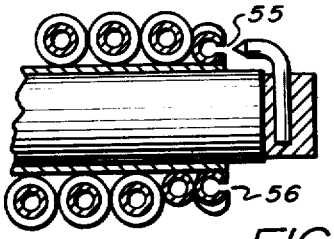
FIG. 3
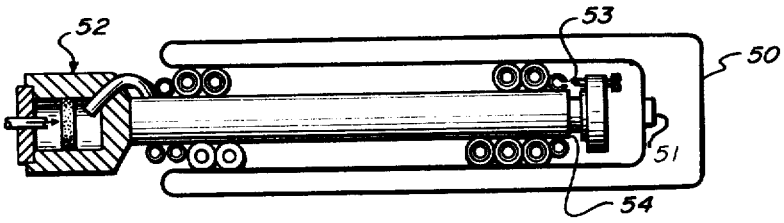
FIG. 2
FIG. 4
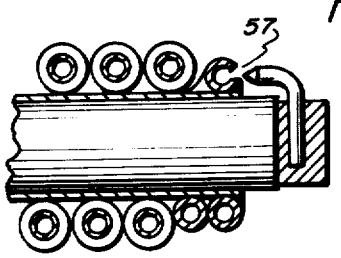

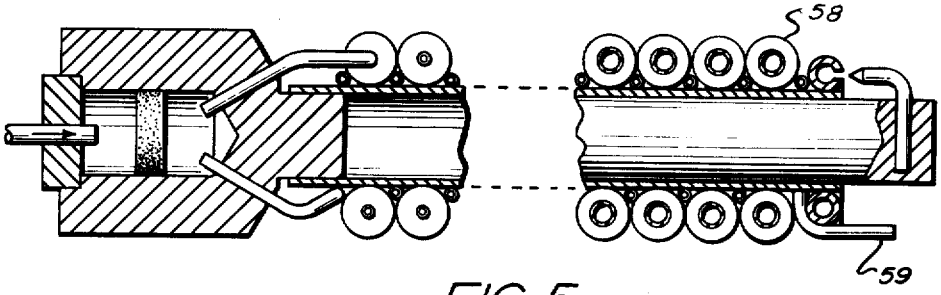
FIG. 5
FIG. 6
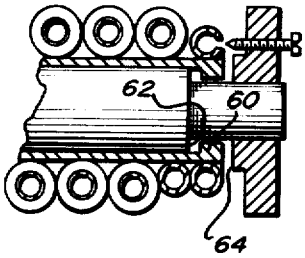
FIG. 7
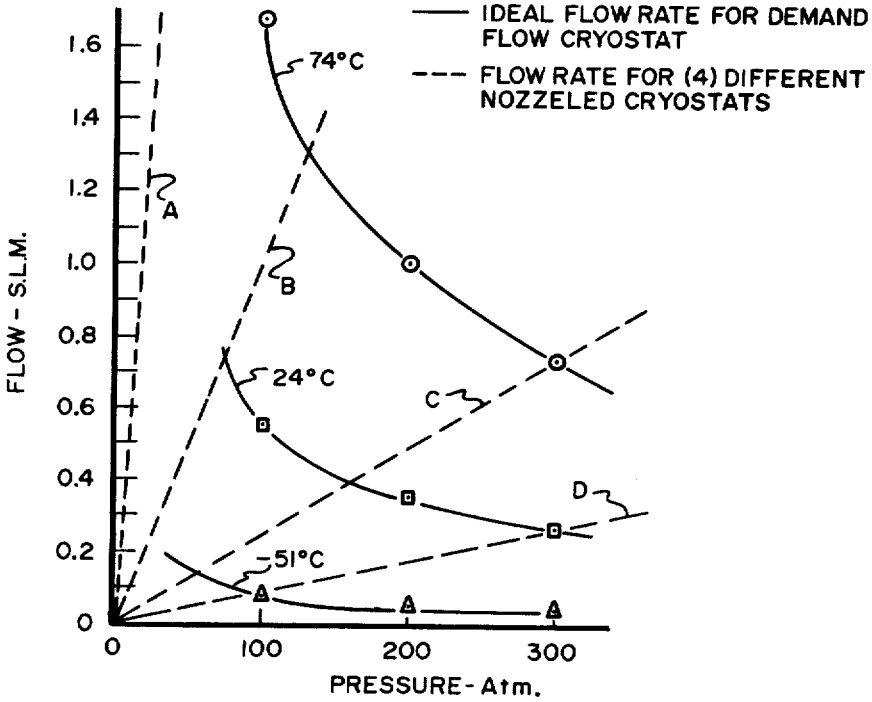

VARIABLE FLOW CRYOSTAT WITH DUAL ORIFICE

BACKGROUND OF THE INVENTION

1. Field of the Invention

The present invention pertains to cryostats used to produce cryogenic refrigeration by expansion of a working fluid (e.g. argon, nitrogen, carbon dioxide) through a Joule-Thompson Orifice. The cryostat can be placed inside of a dewar or other receptacle so that an inventory of liquefied working fluid can be maintained to cool an object such as an infrared detector. Cryostats according to the present invention are of the combined demand flow and fixed flow type which includes means to control the flow of working fluid through the orifice in response to temperature changes in the working fluid.

2. The Prior Art

Demand flow cryostats have been used in cryo-electronic systems such as for cooling infrared detectors and the like. Systems employing this type of detector can be used in ground operation and in airborne detection systems.

Demand flow cryostats of the type wherein flow control is achieved by sensing the presence or absence of a liquefied gas at the cold end of the heat exchanger and using the sensing device to control the size of the Joule-Thompson orifice is shown in U.S. Pat. No. 3,517,525. In these devices operation is normally in an on-off mode because the sensing mechanism is in contact with the liquefied working fluid so that before the sensor will react it must be warmed above the temperature of the liquid at the top of the insulating dewar within which such cryostats are mounted. A significant improvement over the abovementioned cryostats is disclosed in U.S. Pat. No 3,728,868, the spcification of which is incorporated herein by reference.

In addition, to the above other demand flow cryostats wherein an attempt to eliminate thermal cycling are shown in U.S. Pat. Nos. 3,747,365, 3,704,597, and 3,818,720.

British Pat. No. 1,238,470 discloses a demand flow cryostat wherein a bellows actuated needle valve is actuated by varying the pressure on the bellows disposed inside the mandrel. The cryostat includes a sensor below the valve which is used to signal an external valve between the mandrel and a source of fluid under pressure.

U.S. Pat. No. 3,827,252 discloses a dual orifice cryostat wherein a minimum flow is maintained by the fixed orifice and the variable orifice is utilized continuously to control the rate of refrigeration above the minimum value.

SUMMARY OF THE INVENTION

In working with demand flow cryostats it was discovered that where the Joule-Thompson orifice was constructed so that the orifice was not fully closed by the valve closure member resulting in an operating condition wherein a minimum flow was maintained through the valve and the valve continuously opened and closed to control the rate of refrigeration, the cryostat was subject to more thermal cycling than if the valve could fully close. Therefore, cryostats were developed which provided for a dual orifice so that the cryostat could be operated at full source pressure to achieve rapid cool down after which a first orifice could be closed by a control valve mechanism and a second orifice kept open to provide continuous flow of working fluid through an orifice thus producing an excess of refrigeration than that necessary to maintain maximum heat transfer between the working fluid and an object being cooled by the cryostat.

According to the present invention a cryostat can be provided with a single heat exchanger containing two orifices at the cold end. One orifice is fully controlled from no flow to a maximum flow by a valve member actuated by a mechanism contained within the cryostat. The second orifice contains no valve mechanism and flow through it can only be regulated by controlling flow through the heat exchanger. An external valve can be provided for controlling flow through the heat exchanger and thus the second orifice. Optionally the external valve can be actuated by a solenoid responsive to a sensor disposed adjacent the cold end of the cryostat.

Therefore, it is a primary object of the present invention to provide an improved demand flow-fixed flow cryostat.

It is another object of the present invention to provide a demand flow-fixed flow cryostat with a single heat exchanger and dual orifice.

It is a still further object of the present invention to have a dual circuit cryostat with one circuit being a demand flow type and the second having a fixed orifice.

It is yet another object of the present invention to provide the demand flow-fixed flow cryostat with rapid cool-down characteristics and maximum heat transfer between the working fluid and an object being cooled.

BRIEF DESCRIPTION OF THE DRAWING

FIG. 1 is an elevational view, partially fragmentary, of a cryostat according to the present invention.

FIG. 2 is a schematic presentation of an alternate embodiment of a cryostat according to the present invention.

FIG. 3 is a fragmentary view of the cold end of another cryostat according to the present invention.

FIG. 4 is a fragmentary view of the cold end of an alternate embodiment of a cryostat according to the present invention.

FIG. 5 is a fragmentary view of the cold end of still another embodiment of the cryostat according to the present invention.

FIG. 6 is a fragmentary view of the cold end of another embodiment of the cryostat according to the present invention.

FIG. 7 is a plot of flow versus pressure for combined demand flow-fixed flow cryostats according to the prior art and the present invention.

DESCRIPTION OF THE PREFERRED EMBODIMENT

It has been discovered that at low ambient temperatures, flow through the heat exchanger of a demand flow cryostat is throttled back to such a low flow rate (assuming the orifice is perfect) that the heat transfer between the gas and the dewar is so poor thus causing the detector to warm up. This condition occurs when flow is throttled back to the point where the liquid inventory becomes stagnant through lack of movement. It was observed that if the valve seat is imperfect to the extent that fluid flow remains higher than the flow normally provided by a variable flow orifice good heat transfer between the working fluid and the object being cooled will result. It was also observed that at low ambient temperatures if the working fluid is contaminated and small particles are frozen by the low temperature the orifice will become blocked. If the orifice becomes blocked fluid flow will stop and the cryostat will warm up until the control mechanism opens the valve and lets the contaminant pass through. If the valve seat is imperfect to the extent of the flow noted above small particles of contamination will generally pass through the orifice under conditions of continuous flow.

It has also been observed that a cryostat operating in a dewar with a relatively large volume in which liquid accumulates can have the control upset if the unit is tipped up so the liquid is blown out through the heat exchanger. When this occurs the control mechanism responds by closing the valve thus shutting off the flow of coolant to the detector which then begins to warm up. In the case of a demand flow cryostat if the flow never stops the detector is kept cool during the transient period until equilibrium conditions are reestablished.

Referring to FIG. 1 there is shown a demand flow cryostat 10 which includes a mandrel 12 and a single conduit heat exchanger 14. The heat exchanger 14 includes a central conduit 16 upon which are disposed a plurality of fins. The heat exchanger 14 is wrapped around the mandrel extending from the warm end flange 28 to the cold end designated by the control valve 18 and the fixed orifice 24. The cryostat 10 through and including valve 18 can be identical to the demand flow cryostat shown in U.S. Pat. No. 3,728,868 the specification of which is incorporated herein by reference. Valve 18 can be closed by a needle 20 which is actuated by a bellows actuated control mechanism 13 disposed within mandrel 12, such as shown in the '868 patent. Projecting beyond valve 18 is a length of small diameter tubing 22 which terminates in an orifice 24. The length of tube 22 is selected so that the nozzle orifice 24 has a flow that is small relative to the flow through the variable orifice when it is fully open but larger than the flow that the variable orifice would provide under steady state conditions when cold. Thus the flow rate should be greater than five percent (5%) of the maximum possible flow through the heat exchanger 14 at maximum initial source pressure and maximum ambient operating temperature. As is well known in the art the flow through the fixed orifice can be adjusted by trimming the length of the nozzle tube 22. The cryostat 10 terminates on the warm end in a head 26 which in turn is fixed to a flange 28 and in turn to a high pressure fluid hose adapter 32. The warm end includes a filter 30 to filter out large particles of contaminants from the gas prior to entering into the tube 34 of heat exchanger tube 16. In the embodiment shown in FIG. 1 the cryostat utilizes the variable orifice control mechanism only to provide a high flow for fast cool down of the cryostat 10. Once the cryostat 10 is cold the variable orifice 18 remains closed, the fixed orifice 24 is sized to provide adequate flow for all normal operating conditions at room temperature or below until the source pressure drops to a value approximately one-half the initial pressure. At this time the variable orifice (valve 18) can be utilized to supplement the flow through the fixed orifice 24. In order to conserve gas when the cryostat is designed for continuous steady state operation through the fixed orifice only and the flow would be excessive a solenoid valve (not shown) is installed on the inlet line up-stream of hose adaptor 32. The high pressure working fluid is controlled by the solenoid valve which opens and closes in response to a temperature signal from a sensor at the cold end of the cryostat 10 or the dewar into which the cryostat 10 is placed. In addition to a solenoid valve other control valves such as a vapor bulb actuated valve can be used for control of fluid flow through the heat exchanger 14.

A cryostat according to the present invention provides continuous flow of cold gas to promote a high heat transfer rate in the dewar when the variable valve is closed, thus maintaining a more stable temperature of the cryostat. This has specific advantages in that at low ambient temperatures when the flow rate is otherwise very low or at high gas pressures when the flow rate is low or when the orientation of the cryostat is changed and the liquid inventory changes, the cryostat shows uniform operating characteristics. Thus a cryostat according to the present invention reduces sensitivity to contamination by providing a fixed orifice large enough to pass any small particles that might otherwise block a variable orifice when it is throttled to minimum flow.

The use of an external valve actuated by a cold end temperature sensor permits fast cool down in a dual orifice cryostat, because a high flow rate can be established through the variable orifice followed by on/off control through a fixed orifice with the same efficiency as the variable orifice (valve). Efficient operation in a dewar with a geometry or heat load that is not compatible with the variable orifice control mechanism can also be achieved with the device such as shown in FIG. No. 1.

Referring to FIG. 7 will enable a better understanding of the operation of the cryostat according to the present invention. It is known that flow rate through a cryostat with a fixed orifice is directly proportional to the source pressure. Maximum flow rate is set by the pressure drop through the heat exchanger tube. In the case of nitrogen and argon which are the principal gases used, an increase in flow rate by a factor of about 1.8 occurs as the gas cools from room temperature to the point where the gas produces liquid. Minimum cool down time is achieved by having an orifice at the cold end that restricts the flow to slightly less than the maximum possible.

The ideal flow rate which is characteristic of an acceptable variable orifice cryostat is plotted in FIG. 7 for 74° C., 24° C. and −51° C. ambient temperatures over the normal operating pressure range of 100–300 atmospheres. A typical variable orifice cryostat that operates for 1.5 hours from a given gas bottle supply at 24° C. will operate 0.5 hours at 74° C. and 12 hours at −51° C. Flow rates for different fixed orifice sizes are shown by the curves A, B, C and D. Curve A represents the flow rate through the variable orifice valve before the control mechanism pulls the needle into the orifice. In accordance with the present invention curves B and C, represent two possible fixed orifices that might be used in parallel with the variable orifice of the cryostat of curve A.

Curve D is illustrative of a combined variable and fixed orifice cryostat such as shown in U.S. Pat. No. 3,827,252. Thus it can be seen that at room temperatures and above the variable orifice is always functioning to provide refrigeration at all source pressures below the initial pressure.

Curve C is used to illustrate the operation according to the present invention. Assume an ambient temperature of 24° C. and initial pressure of 300 atmospheres where the flow through the nozzle is greater than the flow would be through the variable orifice, thus the variable orifice would remain closed until the pressure decays to 160 atmospheres (where curve C intersects the 24° C. curve). Below 160 atmosphere the flow through the fixed orifice is not adequate to keep the device cold so that the variable orifice valve opens and provides additional gas required to maintain the operating temperature. If the ambient temperature was 74° C. the variable orifice would be supplying additional gas at all pressures below 300 atmospheres as shown by the intersection of the 74° C. curve with the C curve. Thus at −51° C. the variable orifice will not open until the pressure reaches 50 atmospheres as shown by the intersection of curve C and the −51° C. curve.

Typically, the gas bottle is sized to provide the required operating time at the maximum ambient temperature. In the case of orifice C this would not affect the run time at 74° C. ambient, but does provide the continuous flow of cold gas through the fixed orifice with the changing flow of the variable orifice superimposed on it. At lower ambient temperatures the higher flow rates at high pressures result in shorter run times than the variable orifice alone would provide, but operation is always longer than at 74° C. At −51° C. the fixed orifice provides a flow that is 15 times greater than the variable orifice at 300 atmospheres would provide because the orifice area is 15 times greater, thus greatly reducing the possibility of being blocked by contaminants and having much more stable temperature.

As shown in FIG. 7 nozzle B would be selected for an application where the geometry and heat load of the device being cooled would upset the variable orifice control mechanism. This dual orifice cryostat would typically be used with an inlet solenoid valve actuated by a cold end temperature sensor such as described in relation to the cryostat of FIG. 1. Use of the inlet solenoid valve permits average flow rates nearly equal to the ideal variable orifice cryostats to be achieved.

Previous single circuit fixed orifice cryostats that have used an on/off inlet valve to regulate flow have never approached the ideal variable orifice flow rate because the large orifice used to achieve relatively fast cool down has resulted in such high gas velocities when the unit is cold that the inventory of liquid that is produced is blown out when the valve is opened. In the case of the nozzle according to FIG. 7 curve B the variable orifice serves the primary function of providing fast cool down after which it closes and typically remains closed until the bottle pressure drops to a point to the left of the curve.

Several alternate embodiments to the inventions are shown in FIGS. 2 through 6 wherein the variable orifice is used both to provide initial fast cool down and to maintain the operating condition of the cryostat.

FIG. 2 shows a variable orifice cryostat mounted on a dewar containing a detector 51. The relationship between the needle and the orifice 53 is shown with the cryostat warm and the needle at the maximum limit of the control range. When high pressure gas, e.g. 400 atmospheres nitrogen, is admitted the cryostat cools down as a result of the Joule-Thompson effect. The high pressure gas in the sensor bulb and the bellows is cooled causing the pressure and volume to decrease thus pulling the needle toward the orifice 53. In the conventional variable flow cryostat with a control element the needle would move to the orifice until the flow rate produced just enough refrigeration to satisfy the temperature equilibrium of the control system. In the device of FIG. 2 the control motion range is limited by the shoulder 54 on the sensing bulb which prevents the control element from pulling the needle closer to the orifice. In the embodiment of FIG. 2 it is possible to set the needle out from the orifice by a fixed amount and thus accomplish the stated objective of having a fixed orifice in parallel with a variable orifice. In the apparatus of FIG. 2 it is easy to adjust needle to the minimum fixed position. A device of this kind also prevents the needle from contacting the orifice, thus avoiding wear of the orifice and needle with repeated usage. The needle and orifice are also protected from being damaged by mishandling of the units. If contaminants do collect when the orifice is in its minimum position then the control mechanism will sense that the unit is warming up and cause the needle to move out of the seat thus purging the contaminant.

The embodiment of FIG. 3 shows a fixed orifice separate from the variable orifice. A device of this type containing a variable orifice 55 and a fixed orifice 56 is somewhat simpler to build but will not have the characteristic of being purged of contaminants by motion of the control mechanism.

The apparatus of FIG. 4 contains a variable orifice 57 wherein a fixed orifice is achieved by notching the variable orifice. A device of this type has the advantage of being purged of contaminants by the control mechanism, but the seat is subject to wear and the fixed orifice may change size with time.

FIG. 5 shows another embodiment in which two high pressure tubes 58 and 59 are employed with one terminating in a variable orifice and the other terminating in a fixed orifice.

FIG. 6. shows another embodiment of the mechanism of FIG. 2 in which a second shoulder 62 is added to the sensing bulb that limits the maximum range of control motion. This is sometimes desirable because it permits the maximum flow rate to be set for a desired cool down rate. The two shoulders 62, 64 also provide motion limits determined by annular stop 60 on the mandrel (12 of FIG. 1) that permit the control mechanism to withstand very high shock loads such as are foumd in certain military applications.

Having thus described our invention what is desired to be secured by Letters of Patent of the United States is set forth in the appended claims.

What I claim is:

1. A cryostat of the type wherein a working fluid is expanded through an orifice associated with the cold end of a heat exchanger used to cool the working fluid before expansion through the orifice to produce an inventory of liquefied working fluid adjacent the orifice, the improvement comprising:

first means contained within said cryostat to initiate fluid flow through said orifice at a high rate to provide initial rapid cool-down of said cryostat; said first means interrupting fluid flow after cool-down and remaining inoperative until working fluid source pressure decays to a value approximately one-half the initial value at room temperature and above;

second means associated with said heat exchanger to permit continuous flow of working fluid through said heat exchanger and continuous production of liquefied working fluid;

whereby said cryostat operates with continuous minimum fluid flow to maintain maximum heat transfer between said liquefied working fluid and an object being cooled by said cryostat.

2. A cryostat according to claim 1 wherein said first means includes a bellows actuated needle valve said bellows expanded or contracted in response to temperature changes of a gas filled sensing bulb associated therewith.

3. A cryostat according to claim 1 wherein said first means includes a needle valve actuated by differential expansion or contraction of materials of construction of the valve assembly.

4. A cryostat according to claim 1 wherein said second means includes a non-valved orifice in said heat exchanger.

5. A cryostat according to claim 1 wherein said heat exchanger includes means to limit the degree of closure of said first means.

6. A cryostat according to claim 1 wherein said second means includes a passage in said orifice to permit fluid flow therethrough when said needle valve is in the fully closed position.

7. A cryostat according to claim 1 wherein said first means includes internal valve means to control fluid flow through a first orifice, said second means including non-valved orifice, and means to control fluid flow through said heat exchanger separate from said first orifice.

8. A cryostat according to claim 7 wherein said means to control fluid flow through said heat exchanger includes a valve external to said cryostat actuated by a solenoid energized in response to signals from a sensor at the cold end of said cryostat.

9. A cryostat according to claim 1 wherein said second means includes a separate working fluid passage between the source of working fluid and the cold end of the heat exchanger.

* * * * *